United States Patent [19]

Rowbal

[11] Patent Number: 4,463,952

[45] Date of Patent: Aug. 7, 1984

[54] COLOR MATCH BOARD GAME

[76] Inventor: Robert M. Rowbal, 731 Bluff Ave., Shakopee, Minn. 55379

[21] Appl. No.: 404,530

[22] Filed: Aug. 2, 1982

[51] Int. Cl.[3] ..... A63F 3/00

[52] U.S. Cl. ..... 273/236; 273/156

[58] Field of Search ..... 273/236, 288, 292, 272, 273/294, 156, 157 R

[56] References Cited

U.S. PATENT DOCUMENTS

| | | | |
|---|---|---|---|
| 487,798 | 12/1892 | Thurston | 273/156 |
| 943,435 | 12/1909 | Maris | 273/288 |
| 3,547,444 | 12/1970 | Williams et al. | 273/294 |
| 3,788,645 | 1/1974 | Nelson | 273/156 |
| 3,977,681 | 8/1976 | Deitrich | 273/236 |

FOREIGN PATENT DOCUMENTS

| | | | |
|---|---|---|---|
| 132181 | 3/1933 | Austria | 273/294 |
| 3927 of 1893 | | United Kingdom | 273/258 |
| 844983 | 8/1960 | United Kingdom | 273/236 |

OTHER PUBLICATIONS

Major MacMahon, *New Mathematical Pastimes,* Cambridge at the University Press, 1921, pp. 23–25.

*Primary Examiner*—Richard C. Pinkham
*Assistant Examiner*—Scott L. Brown
*Attorney, Agent, or Firm*—Malcolm Reid

[57] ABSTRACT

A board game wherein the playing board has color-coded sides and color chips having each side color-coded are placed by opposing players on the playing board adjacent to other color chips and the color-coded sides of the board so that the colors of each adjacent chip match one another and so that the color of each chip which is adjacent to a color-coded side of the board also matches the color-coded side.

9 Claims, 5 Drawing Figures

COLOR MATCH BOARD GAME

BACKGROUND OF THE INVENTION

1. Field of the Invention

This invention relates generally to a board game and, more particularly, to a board game wherein a playing board having color-coded sides is utilized and square color chips having each side color-coded by dividing the color chip into four equal triangular areas, the sides of the color chip forming the base of each of the four triangles, each triangular area being colored, are placed on the playing board by opposing players adjacent to one another so that the colors of each adjacent chip match one another and so that the color of each chip match one another and so that the color of each chip which is adjacent to a color-coded side of the board also matches the color-coded side.

2. Description of the Prior Art

Many varieties of board games exist. Most utilize a board that requires linear movement around a track and entail the use of dice to govern the extent of the move. Most of these games have a narrow range of ages to which they appeal. They often have a fairly detailed and rigid set of rules. Other board games, such as checkers and chess, do not require linear movement around a designated track on the board. A game such as chess, however, can require many intricate and complex thought patterns to ensure a win. A game such as checkers, on the other hand, can be played in a less serious fashion and in a quicker manner. The present invention comes closer to the order of checkers with respect to the level of intensity and the complexity of thought patterns necessary to successfully beat an opponent. The present invention uses a scoring system to win but can also be played without scoring. The present invention can be enjoyably played by ages from 6 to 99. It is colorful and pleasant to look at and does not require the use of dice or employ a linear track. The game, unlike checkers, can be played by two to four players.

SUMMARY OF THE INVENTION

The present invention comprises a square playing board and square color chips. The playing board is rectilinearily divided into 64 squares. Each square is approximately the same size as that of a color chip. Each square which borders on the edge of the board is marked on its side abuting the edge of the playing board with a color. The colors used to mark the side of these squares corresponds to the colors of the squares. The color chips are also square. The present configuration uses forty-eight (48) square color chips. The edge of each color chip is marked with a color. Some of these colors do not appear on the edges of the playing board. All of the colors which appear on the edges of the playing board are used on the color chips. The present configuration uses the following colors on the color chips: (1) black, (2) green, (3) blue, (4) red, (5) yellow and (6) white. The present configuration uses the following colors along the edge of the playing board to mark the outside edge of those squares nearest the edge of the playing board: (1) red, (2) yellow, (3) white.

The color chips are divided into four triangular areas. Each triangular area utilizes a side of the square color chip as the base of the triangle. Each triangle is colored.

The colors used on the edges of the playing board are the three colors which are of the highest frequency of use on the color chips. If scoring is used, they are also the colors which earn the lowest points in a system where the highest total number of points wins.

The actual colors used may be varied, depending upon the desire of the manufacturer of the game. The frequency of use of a particular color may be varied, depending upon the level of difficulty desired by the manufacturer. The number of color chips can be varied, as desired by the manufacturer. Even the number of squares in the playing can be varied by the manufacturer.

The exact mix of number of squares on the board, number of color chips, frequency of occurrence of particular colors on the color chips, point value for the colors, and colors appearing on the edge of the playing board can all be varied, no doubt in accordance with some mathematical law of probability to arrive at the proper layout for the most enjoyable and challenging playing for a particular age group, mood of a player, or level of intellectual ability.

The game is played by one of the players placing a chip along the outside edge of the playing board. The color on the side of the color chip placed adjacent to the color on the edge of the playing board must match. Thereafter, the opposing player must match one side of a color chip to one side of the color chip which was first placed on the playing board. The first player then has another turn to place a color chip on the playing board and so on, each player alternating turns. Each time a color chip is placed on the playing board, the colors on all its sides must match the colors on each color chip and on each outside edge of the board to which the color chip being played is placed adjacent.

Points are given for each color matched according to a scoring system. A color chip cannot be played unless it can be color matched to each other color chip and side of the playing board to which it abuts. After the first color chip is played on the side of the board, no further color chips can be played against the side of the board unless it also abuts and matches another color chip.

BRIEF DESCRIPTION OF THE DRAWINGS

Referring to the drawings, wherein like numerals represent like parts throughout the several views.

DESCRIPTION OF THE PREFERRED EMBODIMENT

Figure 1:
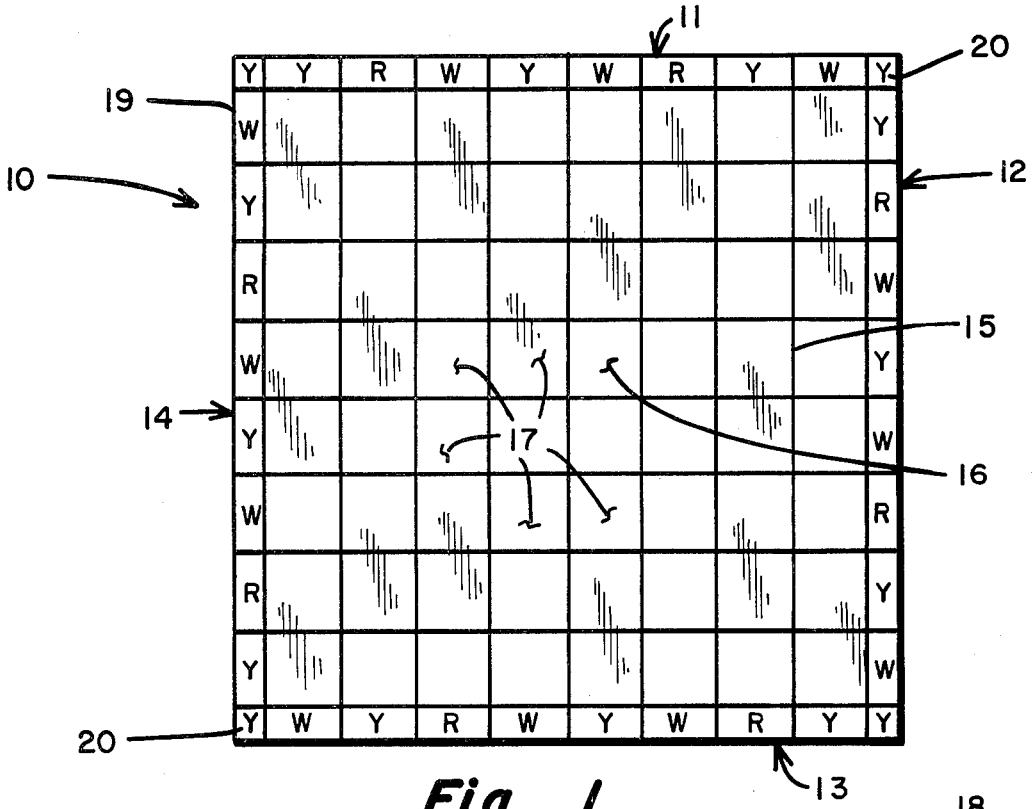
FIG. 1 is a plan view of a playing board without color chips in place on the board.

Referring to the figures, there is generally illustrated at 10 in FIG. 1 a playing board configured for use with forty-eight (48) color chips. The playing board 10 is fabricated from plastic, cardboard, wood, or any other suitable material. The present configuration utilizes a playing board 10 which is square and approximately 14 inches by 14 inches. The playing board 10 is divided into a central playing area 16 which is 13 inches by 13 inches. The central playing area is divided into 64 playing squares 17 with eight playing squares 17 on each side of the board. Each playing square 17 is defined by white lines or grid lines 15 which extend from a first edge 11 to a third edge 13 and extend from a second edge 12 to a fourth edge 14. Edges 11 and 13 are opposite one another. Edges 12 and 14 are also opposite one another. Each grid line 15 is colored white and is one-eighth (⅛) inch thick to create a visually pleasing effect. There are nine grid lines 15 extending from edge 11 to edge 13 and nine grid lines 15 extending from edge 12 to edge 14. Each playing square 17 has the same dimensions as every other playing square 17. The central playing area 16 is defined by the white grid lines 15 which are in closest proximity to edges 11, 12, 13 and 14, respectively. The interior of the playing squares 17 may be colored any visually pleasing color. It has been generally found that a neutral color for the interior of the playing square 17 is most pleasing since color chips 18 will be placed on the playing board 10 during the game and each of these color chips are brightly colored with multiple colors. Therefore, the background of the playing board 10 should contrast with these colors and should not detract from the visual effect of the color chips 18. The perimeter rectangles, one of which is shown at 19 for illustration, are colored sequentially around the playing board 10 beginning at the upper left hand corner perimeter rectangle 19 on playing board 10. The sequence begins with yellow, then red, and then white. The sequence is repeated in a clockwise direction around edge 11 to edge 12, to edge 13 and ending at the uppermost perimeter rectangle 19 on edge 14, which perimeter rectangle is colored white. Each perimeter rectangle 19 in FIG. 1 is marked with the letters Y, R or W. Y denotes yellow, R denotes red and W denotes white. the corner squares 20 are each colored yellow.

Figure 2:
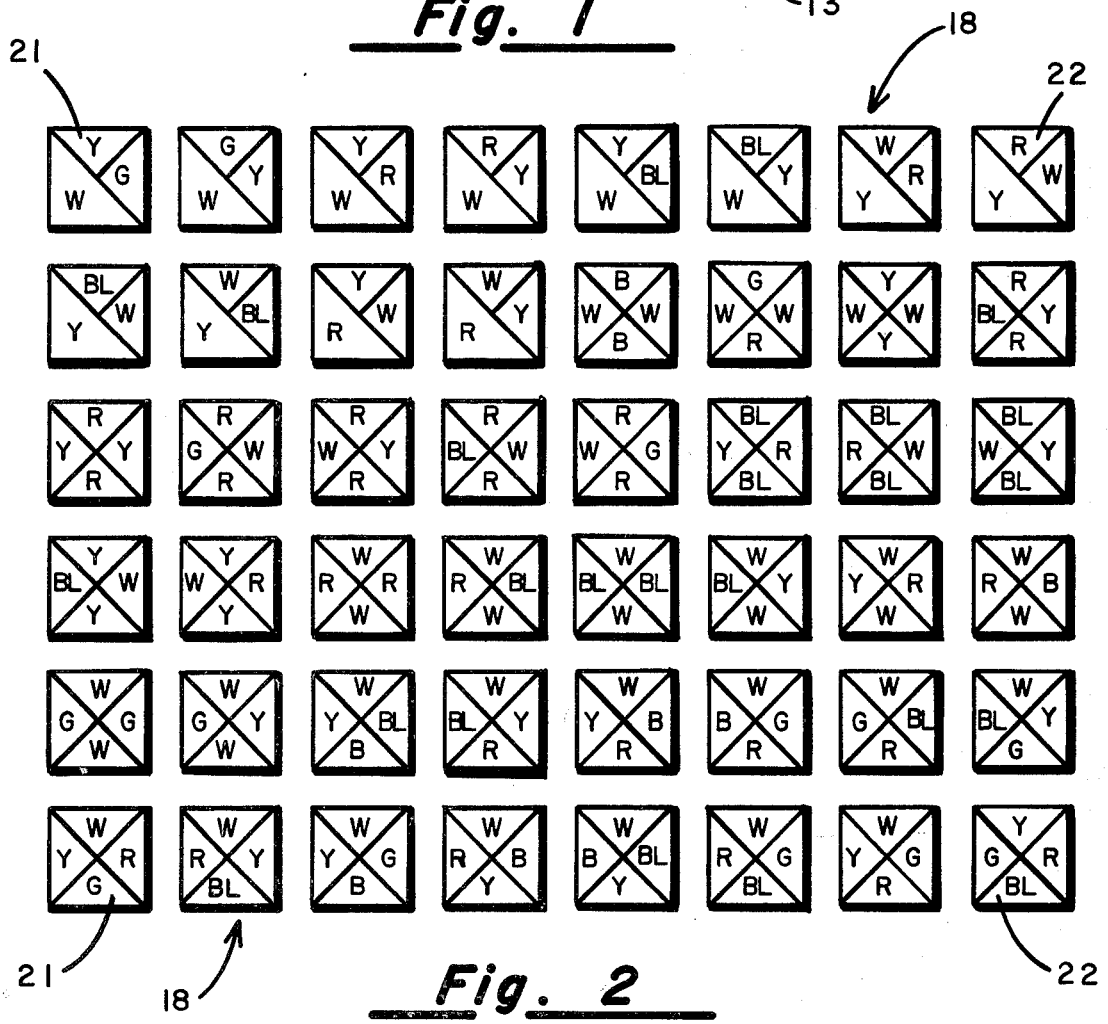
FIG. 2 is a view of forty-eight (48) color chips for use with the playing board.

FIG. 2 illustrates forty-eight (48) color chips 18 for use with the playing board 10. Each color chip is square and is sized to completely cover a playing square 17 and one-half of the width of the grid line 15 which defines the respective playing square. Each playing square 17 is divided into either three or four triangular areas 21. Each triangular area is colored. The colors used with the present configuration of this invention are shown in FIG. 2 where B denotes black, G denotes green, BL denotes blue, R denotes red, Y denotes yellow and W denotes white. The color chips 18 which are divided into four equal triangular areas 21 utilize each color chip side 22 as the base of the triangle with the apex of each triangle coinciding and being located at the center of the color chip 18. The color chips 18 which are divided into three equal triangular areas 21 are first diagonally divided in to halves. One half is color coded with a single color. The other half is further divided into two triangular areas 21 utilizing the color chip sides 22 as the base of the two triangular areas 21 and having the apex of these two triangular areas 21 coinciding at the center of the color chip 18. Each of these two triangular areas 21 are then color coded with colors which are dissimilar to any other color on that color chip 18.

Figure 3:
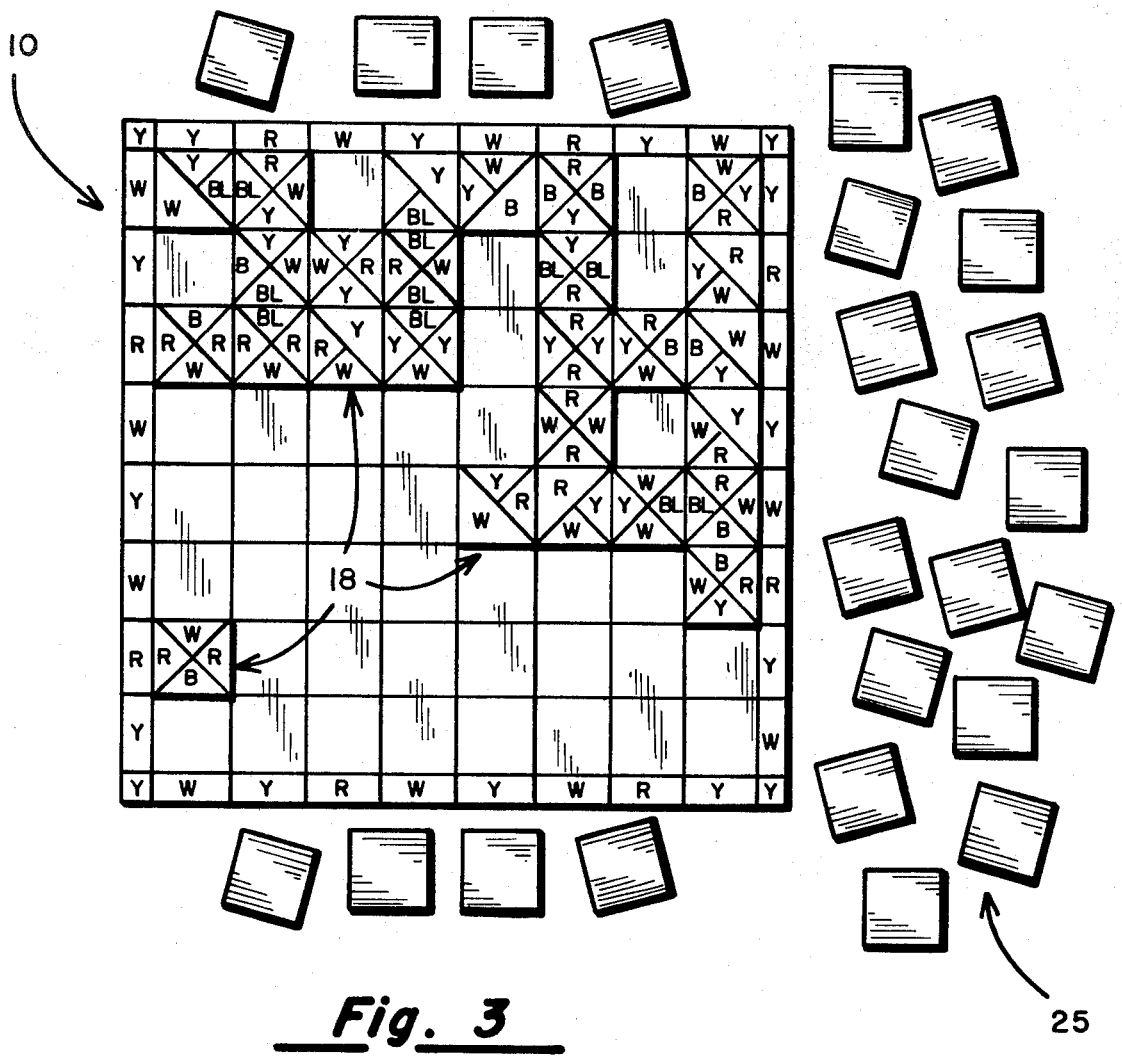
FIG. 3 is a view of the playing board with color chips in place on the board, illustrating a game in progress with the balance of the color chips placed upside down around the board.

FIG. 3 illustrates the playing board 10 with some of the color chips 18 in place on the playing board 10, as they would be during a typical game. The remaining color chips 18 are placed upside down around the playing board 10 as they would be placed during a typical game.

The color chips 18 may be fabricated from the same materials as the playing board 10 or of dissimilar materials as would provide the most pleasing visual effect for the intended market for the color match game.

Figure 4:
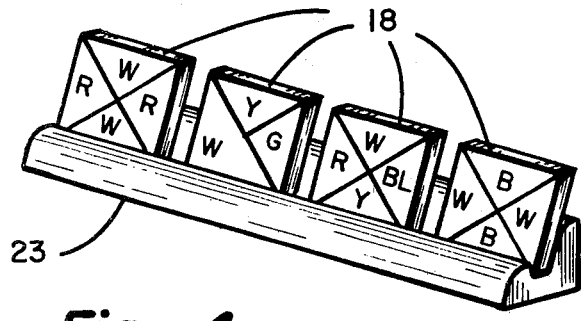
FIG. 4 is a perspective view of a holder for four color chips.

FIG. 4 illustrates a typical holder 23 for four color chips 18. The holder 23 may be fabricated from any suitable material. It must be designed to hold four color chips 18 in such a position that the player can see the colored faces of the color chips 18 but so that the opposing player cannot see the colored faces. The holder 23 may be similar to the holder 23 used in the game Scrabble® for holding the letters used in that game. The design of the holder as illustrated in FIG. 4 is simple and achieves these requirements. Any other design which achieves these requirements set forth above would also be suitable.

Figure 5:
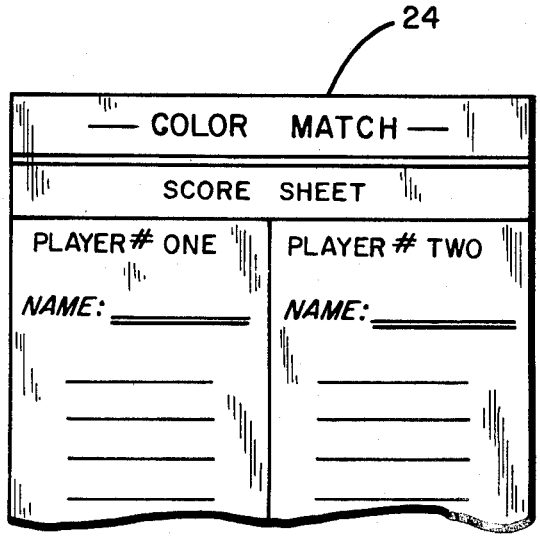
FIG. 5 is a score sheet.

FIG. 5 illustrates a suitable example of a score sheet 24 which may be utilized in conjunction with the color match game of this invention. Four players may also play the color match game. In that event, the use of two score sheets 24 may be used. It is contemplated that pre-printed score sheets 24 would be provided when the color match game is packaged for retail sales. However, any scrap of paper could be utilized to keep score. The score sheet 24 of FIG. 5 is shown only for illustrative purposes. Score sheets 24 of many different designs would no doubt be equally as effective as the one illustrated.

OPERATION OF THE PREFERRED EMBODIMENT

The color match game may be played with two or four players. The game is started by placing the playing board 10 in an area central to all players. The forty-eight color chips 18 are placed in close proximity to the playing board 10 with their colored sides turned down so that the colors cannot be seen. Each player draws four color chips 18 from the upside down and randomly placed color chips 18. The player conceals the color side of the color chips 18 from his opponent at all times until the color chip 18 is played. To aid in concealing the colors of the color chips 18 which a player has drawn and, in turn, to allow the player to view those colors, the player places his drawn color chips 18 color side up on the holder 23, which is positioned so that it faces the player only. Each player, in turn, draws four color chips 18 and places them on his holder 23. To determine who draws their color chips 18 first, a numbered die may be cast with the player receiving fthe highest number drawing first. In the event of ties, the tieing players cast the die again until the tie is broken. Succeeding players draw their four color chips 18 in clockwise order around the board.

The numbered die may again be used to determine who makes the first play in the same manner that it was used to determine the first player to draw the color chips 18. Again, the order of play is in a clockwise direction, which continues in that direction until the game has been completed.

The first player can place a color chip 18 on any playing square 17 abutting any perimeter rectangle 19. The color on the side of the color chip 18 which is placed adajcent to the perimeter rectangle 19 must match the color of that perimeter rectangle 19. Any points which are scored are then recorded on the score sheet 24 under the column marked with that player's name or other designation. The player then draws another color chip 18 from the bank 25 of overturned color chips 18 near the playing board. It then becomes the second player's turn. The succeeding players execute their turn in the same manner as the first player, except that the succeeding players must match one of their color chips 18 against a color chip 18 which is already on the playing board 10. A color chip 18 may be placed adjacent one or more other color chips 18 and a perimeter rectangle 19. Each color chip 18 must be placed so that each side of a color chip 18 which is adjacent to the side of another color chip 18 and/or perimeter rectangle 19 matches the color of the adjacent side of the other color chips 18 and/or perimeter rectangle 19. The succeeding players are not at liberty to place their color chip 18 only against a perimeter rectangle 19. Their color chip must primarily be placed adjacent another color chip 18 and only secondarily against a perimeter square 19.

A variation of the game allows succeeding players to place a color chip against only a perimeter rectangle 19 along an edge 11, 12, 13 or 14 of the playing board 10 which previously has had a color chip placed adjacent to it.

Points are scored each time a player matches another color. If more than one color is matched in any single play, the player is then allowed the total points of all colors matched. The scoring value of each color is as follows:

Black 5
Green 4
Blue 3
Red 2
Yellow 1
White 0

A player can have only four color chips 18 at a given time in his holder and it is a requirement that four color chips 18 be in the holder at any given time. This necessitates the drawing of a color chip 18 by a player immediately after each play. The game can be played so that a player forgetting to draw another color chip 18 after his play may be penalized one point.

All color chips 18 must match all colors adjacent to it.

The first player is the scorekeeper.

All color chips 18 played must be placed adjacent either another color chip 18 or a perimeter square 19. You cannot place color chips 18 at random on any playing square 17.

After all color chips 18 are drawn from the bank 25, play continues until all color chips 18 held by each player are placed on the playing board 10. If at any time a player cannot find a playing square on which to place any of his remaining color chips 18, he must pass his turn for play to the next player in the succession. If at any time none of the players can place their remaining color chips 18 on a playing square 17, the game ends. All remaining color chips 18 are then turned face up so that each player can observe their colors. The total number of all the colors on each remaining color chip 18 held by a player are subtracted from that player's score. The player scoring the most points is the winner.

For those color chips 18 which are divided into three triangular areas 21, scoring is determined by the color appearing at each side of the color chip 18. For example, a color chip 18 with a white side, a red side and two yellow sides, the total points subtracted from a player's score who was left holding this color chip 18 would be white=0, red=2, yellow=1, and another yellow=1, for a total of four (4). Likewise, if this color chip were placed adjacent four of the same colors on a perimeter square 19 and three color chips 18 or adjacent four color chips 18 which were on the playing board, the total points added to the players score would be 4.

As in most games, a certain amount of luck in drawing advantageous color chips 18 is present. However, as a player gains experience with the game, players develop certain methods of strategy. A player learns to set up plays which may consist of a series of placements of color chips 18 in anticipation of the intervening plays of the opponent. A player may find it advantageous to place a color chip 18 for the purpose of blocking a set-up of an opponent. A high scoring color chip 18 side may be placed on the playing board 10 in such a manner that an opponent would not be able to match the high score color side of the color chip 18.

As previously mentioned, there are many possible variations of the rules which may be established and still allow the use of the basic concept of matching the colors of the color chips 18 placed by opponents on the playing board 10. The actual colors used, as well as the point value assigned those colors may be varied. The size of the playing board 10, as well as the size of the color chips 18, are subject to variation. The number of playing squares 17, as well as the number of color chips, may be varied. The frequency of occurrence of any particular color is subject to variation and would have an effect on the difficulty of play. Scoring may be dispensed with entirely. This is especially advisable when the game is being played by young children. It has been found that even four year old children can enjoy the game if the goal is simply to match the colors without score keeping. They lack the sophistication of a strategy to win but seem to enjoy the game on the level of a puzzle without the competitive motive to win.

What is claimed is:

1. A board game comprising:

(a) a square playing board having playing squares, a first playing square which abutts a first perimeter edge of the playing board having that portion of the perimeter edge which abuts the first playing square marked with a color from a group of three colors, a second playing square which abuts the first playing square and the first perimeter edge having that portion of the perimeter edge which abuts the second playing square marked with one of the two remaining colors, a third playing square which abuts the second playing square and the first perimeter edge having that portion of the perimeter edge which abuts the third playing square marked with the remaining of the three colors, the group of three colors repeating around the remaining three perimeter edges of the playing board; and (b) color chips, each the same size as the playing squares, each color chip divided into triangularly colored areas wherein each side of a color chip is a side of a triangular colored area, the triangularly colored areas being colored with a color from a group consisting of six colors, three of which are the same colors as contained in the group set forth in subpart (a) of this claim 1.

2. The board game of claim 1, wherein the color chips comprise:

(a) 12 color chips, the surfaces of each of which are divided into 3 triangularly colored areas, and (b) 36 color chips, the surfaces of which are divided into 4 triangularly colored areas.

3. The board game of claim 1, wherein the scoring comprises awarding points to a player for each color on a color chip which is matched to the color on an adjacent color chip or on an adjacent perimeter edge on the playing board only if each edge of the played color chip matches all of the colors on any adjacent playing board perimeter edge and adjacent color chip edge.

4. The board game of claim 3, wherein the scoring also comprises assigning point values to each of the colors on the color chips.

5. The board game of claim 3, wherein certain of the colors on the color chips have a greater frequency of occurrence than do others.

6. The board game of claim 3, wherein the scoring also comprises assigning point values to each of the colors on the color chips in direct proportion to the frequency of occurrence of any given color.

7. The board game of claim 1, wherein it is played by a player randomly choosing four color chips and then choosing from those four, a single color chip on a non-random basis for placement on a playing square of the player's choice adjacent to a perimeter edge of the playing board and/or to another color chip, alternate players repeating this play.

8. The board game of claim 7, wherein completion occurs when one of the following occurs:

(a) all color chips are used up, or (b) it is not possible to color match the remaining color chips.

9. A board game comprising:

(a) a playing board having 64 playing squares, forming an 8×8 square array, a first playing square which abuts a first perimeter edge of the playing board having that portion of the perimeter edge which abuts the first playing square marked with the color yellow, a second playing square which abuts the first perimeter edge and the first playing square having that protion of the perimeter edge which abuts the second playing square marked with the color red, in like manner the next portion of the first perimeter edge marked with the color white, the next portion marked with the color yellow, the next portion white, the next portion red, the next portion yellow, and the final portion of the first edge marked with white, each successive perimeter edge of the playing board having the same repeating pattern of colors, and (b) color chips, each the same size as the playing squares, each color chip divided into triangularly colored areas wherein each side of a color chip is a side of a triangular colored area, the triangularly colored areas being colored with a color from the group consisting of yellow, green, white, red, black and blue.

* * * * *